US009464490B2

(12) United States Patent
Zhang et al.

(10) Patent No.: US 9,464,490 B2
(45) Date of Patent: Oct. 11, 2016

(54) GAGE CUTTER PROTECTION FOR DRILLING BITS

(71) Applicant: SMITH INTERNATIONAL, INC., Houston, TX (US)

(72) Inventors: Youhe Zhang, Spring, TX (US); Michael G. Azar, The Woodlands, TX (US); Chen Chen, The Woodlands, TX (US); Yuri Burhan, Spring, TX (US)

(73) Assignee: Smith International, Inc., Houston, TX (US)

( * ) Notice: Subject to any disclaimer, the term of this patent is extended or adjusted under 35 U.S.C. 154(b) by 446 days.

(21) Appl. No.: 13/836,603

(22) Filed: Mar. 15, 2013

(65) Prior Publication Data

US 2013/0292186 A1 Nov. 7, 2013

Related U.S. Application Data

(60) Provisional application No. 61/642,351, filed on May 3, 2012.

(51) Int. Cl.

| | |
|---|---|
| ***E21B 10/43*** | (2006.01) |
| ***E21B 17/10*** | (2006.01) |
| *E21B 10/42* | (2006.01) |

(52) U.S. Cl.

CPC ..... *E21B 17/1092* (2013.01); *E21B 10/43* (2013.01); *E21B 2010/425* (2013.01)

(58) Field of Classification Search

CPC ..... E21B 17/1092; E21B 2010/425; E21B 10/43; E21B 10/54; E21B 10/42

See application file for complete search history.

(56) References Cited

U.S. PATENT DOCUMENTS

| | | | | |
|---|---|---|---|---|
| 4,602,691 | A * | 7/1986 | Weaver | 175/430 |
| 4,941,538 | A * | 7/1990 | King | 175/431 |
| 5,531,281 | A * | 7/1996 | Murdock | 175/431 |
| 5,904,213 | A | 5/1999 | Caraway et al. | |
| 6,089,336 | A | 7/2000 | Nexton et al. | |
| 6,123,160 | A * | 9/2000 | Tibbitts | E21B 10/26 175/385 |
| 6,206,117 | B1 * | 3/2001 | Tibbitts et al. | 175/399 |
| 6,253,863 | B1 * | 7/2001 | Mensa-Wilmot et al. | 175/408 |
| 6,298,930 | B1 | 10/2001 | Sinor et al. | |

(Continued)

FOREIGN PATENT DOCUMENTS

| | | |
|---|---|---|
| CN | 201474617 U | 5/2010 |
| EP | 869256 B1 | 6/2004 |
| GB | 2352745 A | 2/2001 |

OTHER PUBLICATIONS

Ortiz, et al., "Improved Bit Stability Reduces Downhole Harmonics (Vibrations)", SPE 36413—SPE/IADC Asia Pacific Drilling Technology, Kuala Lumpur, Malaysia, Sep. 9-11, 1996, pp. 1-11.

(Continued)

*Primary Examiner* — Blake Michener
(74) *Attorney, Agent, or Firm* — Colby C. Nuttall

(57) ABSTRACT

A downhole cutting tool may include a tool body, a plurality of blades extending azimuthally from the tool body comprising a cone region, a shoulder region, and a gage region, at least one cutting element disposed along the cone region and the shoulder region of the blade, and at least one gage cutting element disposed along the gage region of the blade wherein the at least one gage cutting element has a negative backrake ranging from greater than 70 to about 85 degrees.

14 Claims, 10 Drawing Sheets

(56) References Cited

U.S. PATENT DOCUMENTS

| | | | | |
|---|---|---|---|---|
| 6,321,862 | B1 * | 11/2001 | Beuershausen | E21B 17/1092 175/393 |
| 6,349,780 | B1 * | 2/2002 | Beuershausen | 175/408 |
| 6,394,202 | B2 | 5/2002 | Truax et al. | |
| 6,408,958 | B1 * | 6/2002 | Isbell | E21B 10/43 175/431 |
| 6,427,792 | B1 * | 8/2002 | Roberts et al. | 175/431 |
| 6,443,249 | B2 | 9/2002 | Beuershausen et al. | |
| 6,460,631 | B2 * | 10/2002 | Dykstra | E21B 10/42 175/428 |
| 6,536,543 | B2 * | 3/2003 | Meiners et al. | 175/431 |
| 6,575,256 | B1 * | 6/2003 | Doster | E21B 10/43 175/431 |
| 6,684,967 | B2 * | 2/2004 | Mensa-Wilmot | E21B 10/26 175/408 |
| 6,779,613 | B2 | 8/2004 | Dykstra et al. | |
| 6,935,441 | B2 | 8/2005 | Dykstra et al. | |
| 7,000,715 | B2 * | 2/2006 | Sinor et al. | 175/431 |
| 7,096,978 | B2 | 8/2006 | Dykstra et al. | |
| 7,686,104 | B2 | 3/2010 | Singh et al. | |
| 7,703,559 | B2 | 4/2010 | Shen et al. | |
| 7,726,415 | B1 * | 6/2010 | Tipton et al. | 175/39 |
| 7,798,256 | B2 | 9/2010 | Hoffmaster et al. | |
| 7,814,990 | B2 | 10/2010 | Dykstra et al. | |
| 7,861,809 | B2 * | 1/2011 | Gavia et al. | 175/431 |
| 7,866,419 | B2 | 1/2011 | Lockwood | |
| 8,006,785 | B2 | 8/2011 | Oldham et al. | |
| 8,066,084 | B2 | 11/2011 | Dykstra et al. | |
| 8,096,373 | B2 * | 1/2012 | Patel | E21B 10/003 175/426 |
| 8,127,863 | B2 * | 3/2012 | Durairajan | E21B 10/55 175/397 |
| 8,517,125 | B2 | 8/2013 | Lockwood | |
| 2001/0004026 | A1 | 6/2001 | Lockstedt et al. | |
| 2001/0045306 | A1 * | 11/2001 | Fielder et al. | 175/385 |
| 2002/0066601 | A1 * | 6/2002 | Meiners | E21B 10/43 175/431 |
| 2002/0092684 | A1 * | 7/2002 | Singh et al. | 175/339 |
| 2003/0029644 | A1 | 2/2003 | Hoffmaster et al. | |
| 2004/0069531 | A1 * | 4/2004 | McCormick et al. | 175/57 |
| 2006/0081402 | A1 | 4/2006 | Lockwood et al. | |
| 2006/0260845 | A1 * | 11/2006 | Johnson | 175/331 |
| 2007/0079995 | A1 * | 4/2007 | McClain | E21B 10/43 175/426 |
| 2007/0205024 | A1 * | 9/2007 | Mensa-Wilmot | 175/408 |
| 2007/0261890 | A1 * | 11/2007 | Cisneros | 175/331 |
| 2007/0272446 | A1 * | 11/2007 | Mensa-Wilmot | 175/331 |
| 2008/0035380 | A1 | 2/2008 | Hall et al. | |
| 2008/0105466 | A1 * | 5/2008 | Hoffmaster et al. | 175/73 |
| 2008/0179106 | A1 * | 7/2008 | Gavia et al. | 175/431 |
| 2008/0179108 | A1 * | 7/2008 | McClain et al. | 175/431 |
| 2008/0190670 | A1 * | 8/2008 | Welch et al. | 175/430 |
| 2008/0196944 | A1 * | 8/2008 | Tibbitts | 175/66 |
| 2008/0296070 | A1 * | 12/2008 | Shen et al. | 175/421 |
| 2009/0032309 | A1 * | 2/2009 | Schwefe et al. | 175/408 |
| 2009/0120008 | A1 | 5/2009 | Lockwood et al. | |
| 2009/0145669 | A1 * | 6/2009 | Durairajan et al. | 175/431 |
| 2009/0266619 | A1 * | 10/2009 | Durairajan et al. | 175/431 |
| 2009/0308663 | A1 * | 12/2009 | Patel et al. | 175/374 |
| 2010/0133015 | A1 * | 6/2010 | Chen et al. | 175/342 |
| 2010/0219001 | A1 | 9/2010 | Shen et al. | |
| 2011/0005841 | A1 | 1/2011 | Wood et al. | |
| 2011/0100724 | A1 | 5/2011 | Azar | |
| 2011/0284293 | A1 | 11/2011 | Shen et al. | |
| 2011/0290565 | A1 | 12/2011 | Kulkarni | |
| 2011/0297454 | A1 | 12/2011 | Shen et al. | |
| 2012/0024609 | A1 | 2/2012 | Dykstra et al. | |
| 2012/0205163 | A1 * | 8/2012 | Azar et al. | 175/428 |

OTHER PUBLICATIONS

Rajabov, et al., "The Effects of Back Rake and Side Rake Angles on Mechanical Specific Energy of Single PDC Cutters with Selected Rocks at Varying Depth of Cuts and Confining Pressures", SPE 151406—IADC/SPE Drilling Conference and Exhibition, San Diego, California, Mar. 6-8, 2012, pp. 1-17.

International Search Report and Written Opinion issued in PCT/US2013/039237 on Sep. 17, 2013, 15 pages.

Office Action issued in Chinese Patent Application No. 201380031180.3 on Oct. 10, 2015; 20 pages. (w/ English Translation).

* cited by examiner

GAGE CUTTER PROTECTION FOR DRILLING BITS

CROSS-REFERENCE TO RELATED APPLICATION

This application claims the benefit of U.S. Provisional Patent Application Ser. No. 61/642,351 filed May 3, 2012, which is incorporated herein by reference in its entirety.

BACKGROUND

In drilling a borehole in the earth, such as for the recovery of hydrocarbons or for other applications, it is conventional practice to connect a drill bit on the lower end of an assembly of drill pipe sections that are connected end-to-end so as to form a "drill string." The bit is rotated by rotating the drill string at the surface or by actuation of downhole motors or turbines, or by both methods. With weight applied to the drill string, the rotating bit engages the earthen formation causing the bit to cut through the formation material by either abrasion, fracturing, or shearing action, or through a combination of all cutting methods, thereby forming a borehole along a predetermined path toward a target zone.

Many different types of drill bits have been developed and found useful in drilling such boreholes. Two predominate types of drill bits are roller cone bits and fixed cutter (or rotary drag) bits. Most fixed cutter bit designs include a plurality of blades angularly spaced about the bit face. The blades project radially outward from the bit body and form flow channels therebetween. In addition, cutting elements are typically grouped and mounted on several blades in radially extending rows. The configuration or layout of the cutting elements on the blades may vary widely, depending on a number of factors such as the formation to be drilled.

The cutting elements disposed on the blades of a fixed cutter bit are typically formed of extremely hard materials. In a typical fixed cutter bit, each cutting element comprises an elongate and generally cylindrical tungsten carbide substrate that is received and secured in a pocked formed in the surface of one of the blades. The cutting elements typically includes a hard cutting layer of polycrystalline diamond (PCD) or other superabrasive materials such as thermally stable diamond or polycrystalline cubic boron nitride. For convenience, as used herein, reference to "PDC bit" or "PDC cutters" refers to a fixed cutter bit or cutting element employing a hard cutting layer of polycrystalline diamond or other super abrasive materials.

Referring to FIGS. 1 and 2, a conventional fixed cutter or drag bit 10 adapted for drilling through formations of rock to form a borehole is shown. Bit 10 generally includes a bit body 12, a shank 13, and a threaded connection or pin 14 for connecting the bit 10 to a drill string (not shown) that is employed to rotate the bit in order to drill the borehole. Bit face 20 supports a cutting structure 15 and is formed on the end of the bit 10 that is opposite pin end 16. Bit 10 further includes a central axis 11 about which bit 10 rotates in the cutting direction represented by arrow 18.

Cutting structure 15 is provided on face 20 of bit 10. Cutting structure 15 includes a plurality of angularly spaced-apart primary blades 31, 32, 33, and secondary blades 34, 35, 36, each of which extends from bit face 20. Primary blades 31, 32, 33 and secondary blades 34, 35, 36 extend generally radially along bit face 20 and then axially along a portion of the periphery of bit 10. However, secondary blades 34, 35, 36 extend radially along bit face 20 from a position that is distal bit axis 11 toward the periphery of bit 10. Thus, as used herein, "secondary blade" may be used to refer to a blade that begins at some distance from the bit axis and extends generally radially along the bit face to the periphery of the bit. Primary blades 31, 32, 33 and secondary blades 34, 35, 36 are separated by drilling fluid flow courses 19.

Referring still to FIGS. 1 and 2, each primary blade 31, 32, 33 includes blade tops 42 for mounting a plurality of cutting elements, and each secondary blade 34, 35, 36 includes blade tops 52 for mounting a plurality of cutting elements. In particular, cutting elements 40, each having a cutting face 44, are mounted in pockets formed in blade tops 42, 52 of each primary blade 31, 32, 33 and each secondary blade 34, 35, 36, respectively. Cutting elements 40 are arranged adjacent one another in a radially extending row proximal the leading face of each primary blade 31, 32, 33 and each secondary blade 34, 35, 36. Each cutting face 44 has an outermost cutting tip **44*a* furthest from blade tops 42, 52 to which cutting element 40** is mounted.

Referring now to FIG. 3, a profile of bit 10 is shown as it would appear with all blades (e.g., primary blades 31, 32, 33 and secondary blades 34, 35, 36) and cutting faces 44 of all cutting elements 40 rotated into a single rotated profile. In rotated profile view, blade tops 42, 52 of all blades 31-36 of bit 10 form and define a combined or composite blade profile 39 that extends radially from bit axis 11 to outer radius 23 of bit 10. Thus, as used herein, the phrase "composite blade profile" refers to the profile, extending from the bit axis to the outer radius of the bit, formed by the blade tops of all the blades of a bit rotated into a single rotated profile (i.e., in rotated profile view).

Conventional composite blade profile 39 (most clearly shown in the right half of bit 10 in FIG. 3) may generally be divided into three regions conventionally labeled cone region 24, shoulder region 25, and gage region 26. Cone region 24 comprises the radially innermost region of bit 10 and composite blade profile 39 extending generally from bit axis 11 to shoulder region 25. As shown in FIG. 3, in most conventional fixed cutter bits, cone region 24 is generally concave. Adjacent cone region 24 is shoulder (or the upturned curve) region 25. In most conventional fixed cutter bits, shoulder region 25 is generally convex. Moving radially outward, adjacent shoulder region 25 is the gage region 26 which extends parallel to bit axis 11 at the outer radial periphery of composite blade profile 39. Thus, composite blade profile 39 of conventional bit 10 includes one concave region—cone region 24, and one convex region—shoulder region 25.

The axially lowermost point of convex shoulder region 25 and composite blade profile 39 defines a blade profile nose 27. At blade profile nose 27, the slope of a tangent line **27*a* to convex shoulder region 25 and composite blade profile 39 is zero. Thus, as used herein, the term "blade profile nose" refers to the point along a convex region of a composite blade profile of a bit in rotated profile view at which the slope of a tangent to the composite blade profile is zero. For most conventional fixed cutter bits (e.g., bit 10), the composite blade profile includes one convex shoulder region (e.g., convex shoulder region 25), and one blade profile nose (e.g., nose 27). As shown in FIGS. 1-3, cutting elements 40 are arranged in rows along blades 31-36 and are positioned along the bit face 20 in the regions previously described as cone region 24, shoulder region 25 and gage region 26 of composite blade profile 39. In particular, cutting elements 40 are mounted on blades 31-36 in predetermined radially-spaced positions relative to the central axis 11 of the bit 10**.

Without regard to the type of bit, the cost of drilling a borehole is proportional to the length of time it takes to drill the borehole to the desired depth and location. The drilling time, in turn, is greatly affected by the number of times the drill bit is changed in order to reach the targeted formation. This is the case because each time the bit is changed, the entire drill string, which may be miles long, is retrieved from the borehole section by section. Once the drill string has been retrieved and the new bit installed, the bit is lowered to the bottom of the borehole on the drill string, which again is constructed section by section. This process, known as a "trip" of the drill string, involves considerable time, effort, and expense. Accordingly, it is desirable to employ drill bits that will drill faster and longer and that are usable over a wider range of differing formation hardnesses.

The length of time that a drill bit may be employed before it is changed depends upon its rate of penetration ("ROP"), as well as its durability or ability to maintain a high or acceptable ROP. Additionally, a desirable characteristic of the bit is that it be "stable" and resist vibration, the most severe type or mode of which is "whirl," which is a term used to describe the phenomenon where a drill bit rotates at the bottom of the borehole about a rotational axis that is offset from the geometric center of the drill bit. Such whirling subjects the cutting elements on the bit to increased loading, which causes premature wearing or destruction of the cutting elements and a loss of penetration rate. Thus, preventing bit vibration and maintaining stability of PDC bits has long been a desirable goal, but one which has not been readily achieved. Bit vibration generally may occur in any type of formation, but is most detrimental in the harder formations.

In recent years, the PDC bit has become an industry standard for cutting formations of soft and medium hardnesses. However, as PDC bits are being developed for use in harder formations, bit stability is becoming an increasing challenge. As previously described, excessive bit vibration during drilling tends to dull the bit and/or may damage the bit to an extent that drill string is prematurely tripped.

There have been a number of designs proposed for PDC cutting structures that were meant to provide a PDC bit capable of drilling through formations of varying hardness at effective ROPs and with acceptable bit life or durability. Unfortunately, may of the bit designs aimed at minimizing vibration result in drilling to be conducted with an increased weight-on-bit (WOB) as compared to bits of earlier designs. For example, some bits have been designed with cutters mounted at less aggressive backrake angles such that increased WOB is used in order to penetrate the formation material to the desired extent. Drilling with an increased or heavy WOB has serious consequences and is generally avoided if possible. Increasing the WOB is accomplished by adding additional heavy drill collars to the drill string. This additional weight increases the stress and strain on all drill string components, causes stabilizers to wear more and to work less efficiently and increases the hydraulic drop in the drill string, requiring the use of higher capacity (and generally higher cost) pumps for circulating the drilling fluid. Compounding the problem still further, the increased WOB causes the bit to wear and become dull much more quickly than would otherwise occur. In order to postpone tripping the drill string, it is common practice to add further WOB and to continue drilling with the partially worn and dull bit. The relationship between bit wear and WIB is not linear, but is an exponential one, such that upon exceeding a particular WOB for a given bit, a very small increase in WOB will cause a tremendous increase in bit wear. Thus, adding more WOB so as to drill with a partially worn bit further escalates the wear on the bit and other drill string components.

Current PDC bits may have preflat or full round gage cutters. However, when the drill bit experiences lateral vibration or doing directional work, the gage cutters are subject to impact loading and may be damaged or worn before the primary cutters. Thus, the loading conditions on current gage cutters may provide high stress near the interface between the diamond and carbide substrate.

Accordingly, there remains a continuing desire for fixed cutter drill bits capable of drilling effectively at economical ROPs and ideally to drill in formations having a hardness greater than in which conventional PDC bits can be employed. More specifically, there is a continuing desire for a PDC bit that can drill in soft, medium, medium hard, and even in some hard formations while maintaining an aggressive cutting element profile so as to maintain acceptable ROPs for acceptable lengths of time and thereby lower the drilling costs presently experienced in the industry.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, one or more embodiments is directed to a downhole cutting tool that includes a tool body; a plurality of blades extending azimuthally from the tool body comprising a cone region, a shoulder region, and a gage region; at least one cutting element disposed along the cone region and the shoulder region of the blade; and at least one gage cutting element disposed along the gage region of the blade wherein the at least one gage cutting element has a negative backrake angle ranging from greater than 70 degrees to about 85 degrees.

In another aspect, one or more embodiments is directed to a downhole cutting tool that includes a tool body; a plurality of blades extending azimuthally from the tool body comprising a cone region, a shoulder region, and a gage region; at least one cutting element disposed along the cone region and the shoulder region of the blade; at least two gage cutting elements disposed along the gage region of the blade, the at least two gage cutting elements having a negative backrake angle ranging from greater than 20 to less than 90 degrees; and a gage pad, wherein at least one gage cutting element is proximate the shoulder region and at least one gage cutting element is proximate the gage pad; wherein the at least one gage cutting element proximate the shoulder region and the at least one gage cutting element proximate the gage pad have differing backrake angles.

In yet another aspect, embodiments disclosed herein relate to a downhole cutting tool that includes a tool body; a plurality of blades extending azimuthally from the tool body comprising a cone region, a shoulder region, and a gage region; at least one cutting element disposed along the cone region and the shoulder region of the blade; at least two gage cutting elements disposed along the gage region of the blade, wherein one of the at least two gage cutting elements trails the other, wherein the other gage cutting element has a negative backrake angle greater than 20 degrees.

Other aspects and advantages of the claimed subject matter will be apparent from the following description and the appended claims.

DETAILED DESCRIPTION

Figure 1:
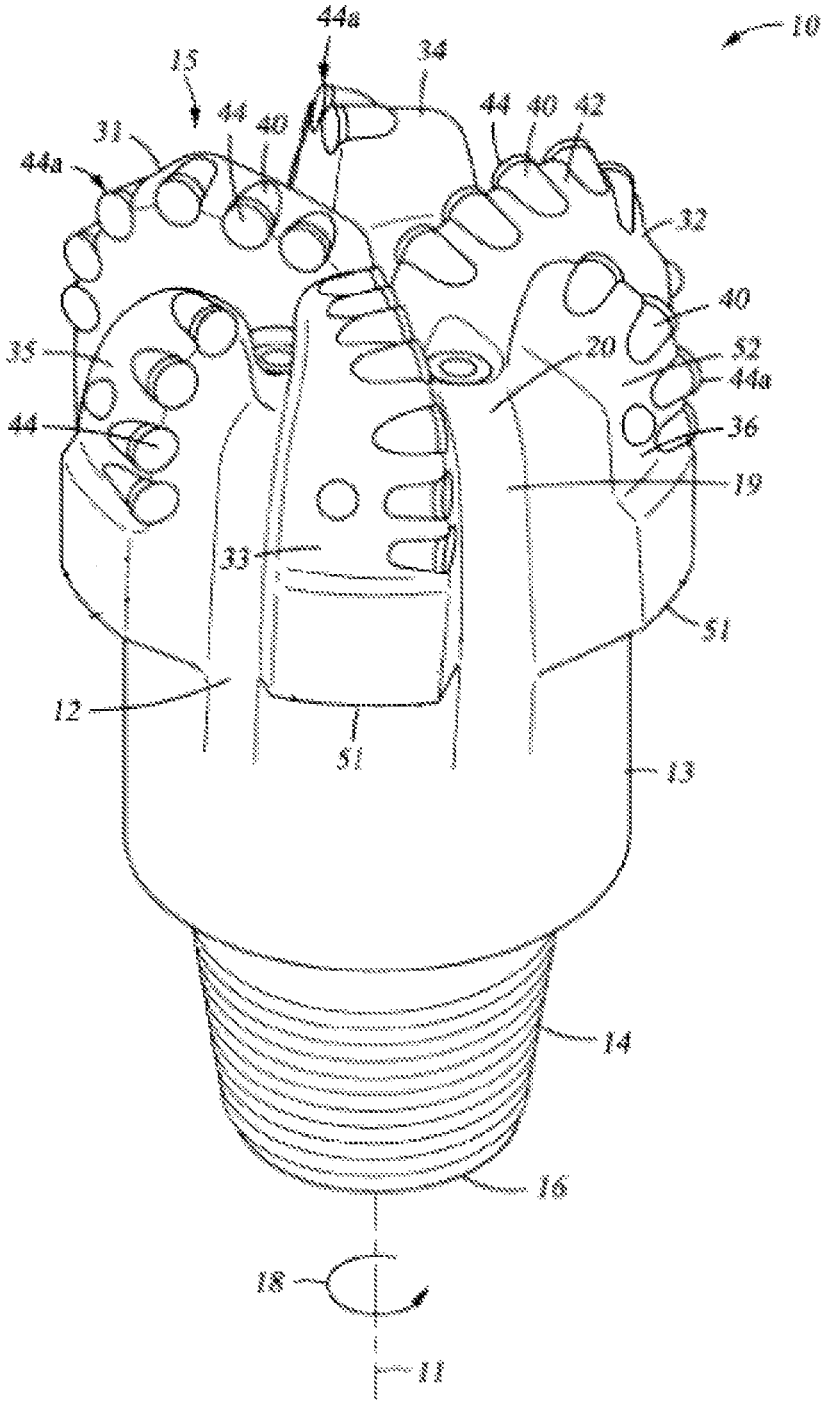
Fig. 1 (PRIOR ART)
FIG. 1 shows a drill bit.

Reference will now be made to the figures in which various embodiments of the present disclosure will be given numerical designations and in which aspects of the present disclosure will be discussed so as to enable one skilled in the art to make and use embodiments disclosed herein.

In one or more aspects, the present disclosure relates to fixed cutter drill bits and other downhole cutting tools and the orientation of cutting elements in the gage region on such drill bits and other downhole cutting tools. Specifically, various embodiments use gage cutting elements oriented on a blade at a high back rake angle, which may result in an advantageous shift in the stresses induced in the cutting elements during drilling.

Generally, severe erosion has been found to occur between cutters, on cutter substrates, and on the blade faces around the cutters. Severe abrasion has also been found to occur across blade tops, cutter substrates, gage pad surfaces and blade heel surfaces of the bit. For example, a conventional 121/4 matrix body bit may lose as much as 10 to 12 pounds of material in a single run when used in an unconsolidated, ultra abrasive application. These bits generally cannot be rebuilt or rerun and have to be scrapped. In a case where a bit may be rebuilt to attempt a second run, the rebuild operations are extensive and often result in thermal stress cracks. Also, wear and damage sustained by the cutters are generally such that the cutters cannot be rotated or reused for a second run.

In horizontal drilling applications, the gage pads suffer excessive wear due to constant rubbing action against the formation and the sharp sands in the abrasive slurry flowing past gage pad surfaces. This can cause a bit to go under gage prematurely. Conventional PDC bits also are often less directionally responsive than roller cone drill bits in these applications and have greater tendency to drill out of a desired zone and into bounding formation without any indication at the surface. PDC bits also have gage surfaces that create multiple points of constant hole wall contact which results in bits going undergage prematurely in these environments. Conventional PDC bits have also been found to be more difficult to trip out of horizontal holes after completing their drilling requirement in these environments. This is because cuttings that fail to reach the surface during the drilling tend to fall to the low side of the hole, effectively creating a restricted passage back to the surface. Additionally, conventional PDC bits have been found to be more susceptible to cutter damage when used to drill out cementing shoes and when engaging more competent formations above or below the reservoir pay zone. Damage sustained by conventional PDC bits in these applications leads to costly rebuild operations or the inability to reuse the bit. Thus, conventional PDC bits have not been economically feasible unconsolidated, ultra abrasive drilling applications and are generally not used.

Figure 4:
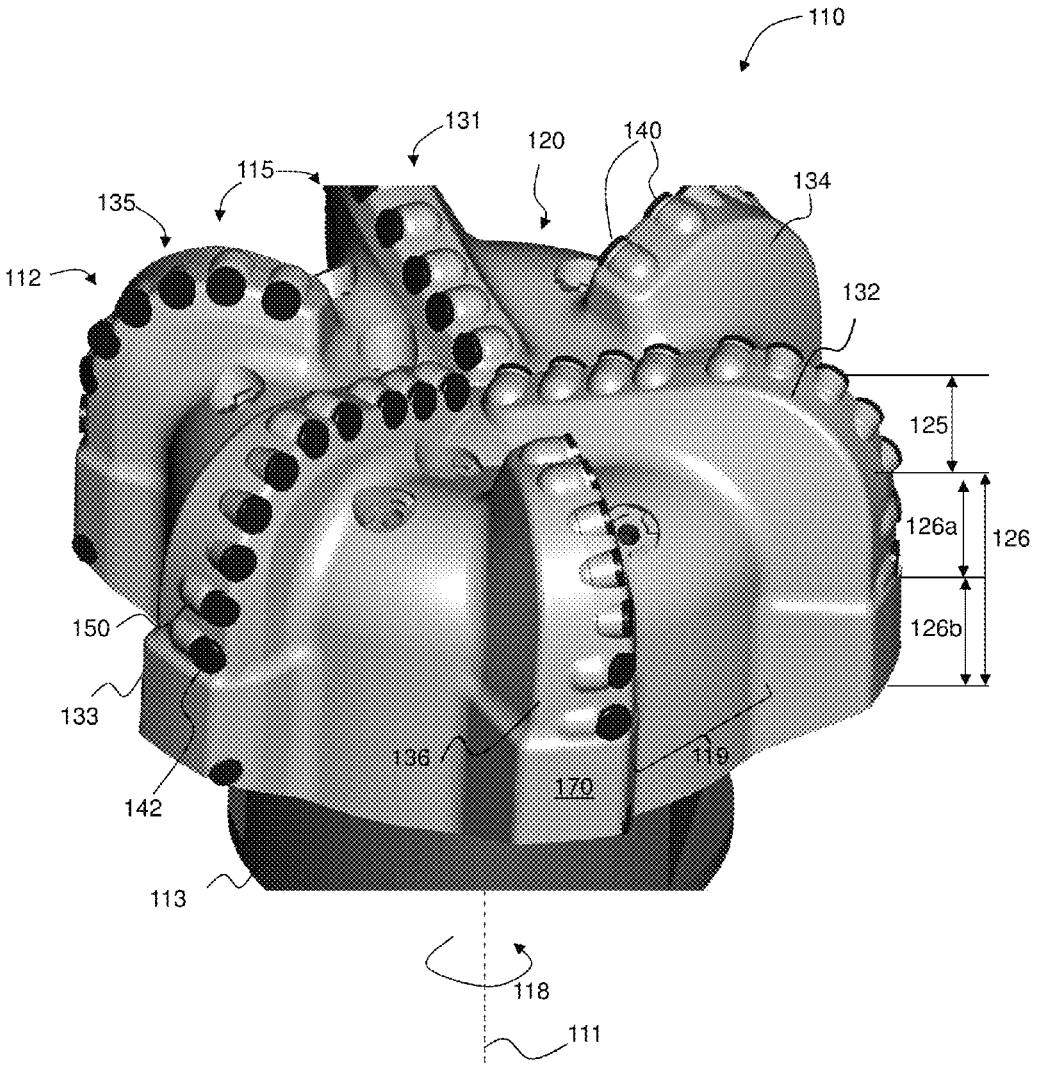
FIG. 4 shows a drill bit according to one embodiment of the present disclosure.

Referring to FIG. 4, an embodiment of a fixed cutter or drag bit 110 adapted for drilling through formations of rock to form a borehole is shown. Bit 110 generally includes a bit body 112, a shank 113, and a threaded connection or pin (not shown) for connecting the bit 110 to a drill string (not shown) that is employed to rotate the bit in order to drill the borehole. Bit face 120 supports a cutting structure 115 and is formed on the end of the bit 110 that is opposite pin end (not shown). Bit 110 further includes a central axis 111 about which bit 110 rotates in the cutting direction represented by arrow 118.

Cutting structure 115 is provided on face 120 of bit 110. Cutting structure 115 includes a plurality of angularly spaced-apart blades 131, 132, 133, 134, 135 and 136, each of which extends from bit face 120. Primary blades 131, 132, 133 and secondary blades 134, 135, 136 extend generally radially along bit face 120 and then axially along a portion of the periphery of bit 110. However, secondary blades 134, 135, 136 extend radially along bit face 120 from a position that is distal bit axis 11 toward the periphery of bit 110. Thus, as used herein, "secondary blade" may be used to refer to a blade that begins at some distance from the bit axis and extends generally radially along the bit face to the periphery of the bit. Primary blades 131, 132, 133 and secondary blades 134, 135, 136 are separated by drilling fluid flow courses 119.

Cutting elements 140 are arranged along blades 131-136 and are positioned along the bit face 120 in regions described as a cone region 124 and a shoulder region 125 while gage cutting elements 142 are positioned in a blade region of a gage region 126. In particular, cutting elements 140 are mounted on blades 131-136 in predetermined radially-spaced positions relative to the central axis 111 of the bit 110. Cone region (not indicated) comprises the radially innermost region of bit 110 and extends generally from bit axis 111 to shoulder region 125. Adjacent cone region (not indicated) is shoulder (or the upturned curve (when the bit is oriented with the face downward to the formation)) region 125. In most conventional fixed cutter bits, shoulder region 125 is generally convex. Moving radially outward, adjacent shoulder region 125 is the gage region 126 which extends parallel to bit axis 111 at the outer radial periphery of the bit. The gage region 126 includes a blade region **126*a* and a gage pad region 126*b*. Gage pad region 126*b* is located axially above the blade region 126*a*, i.e., closer to the pin end 116 than the cutting elements 140, and may include a gage pad 170. The gage pad 170 may extend along the side of the bit blades 131-136 to contact the sides of the borehole (as cut and defined by the gage cutting elements 142), to help maintain stability of the bit 110**, maintain hole diameter, and resist deviation from the borehole axis (without providing an active cutting of the formation).

Located proximately rearward of the gage cutting element 142 (i.e., trailing the gage cutting element 142) may be a stabilization feature 150, such as a wear knot. The stabilization feature 150 may be located in the blade region **126*a* and form a raised profile as compared to the surrounding blade material (or may be a separate insert). The stabilization feature 150 may be at substantially the same exposure as the gage cutting element 142 or may be at slightly greater or less exposure as compared to the gage cutting element 142. In particular embodiments, the stabilization feature 150 may be have a reduced exposure of at least 1 mm, 2 mm, 3 mm, 4 mm, 5 mm, or 6 mm, up to a 8 mm exposure difference, as compared to the gage cutting element 142**.

Figure 2:
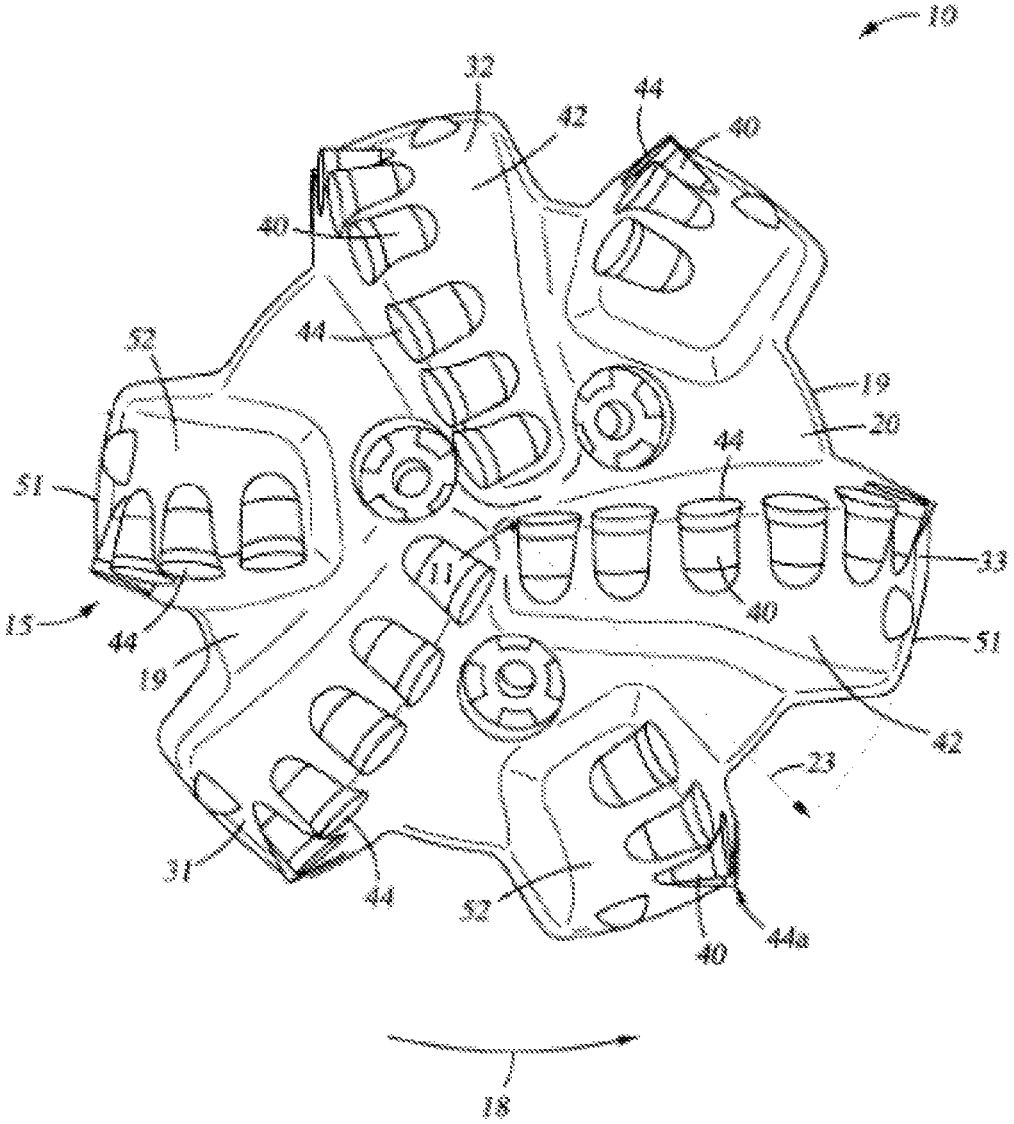
Fig. 2 (PRIOR ART)
FIG. 2 shows a top view of a drill bit.
Figure 3:
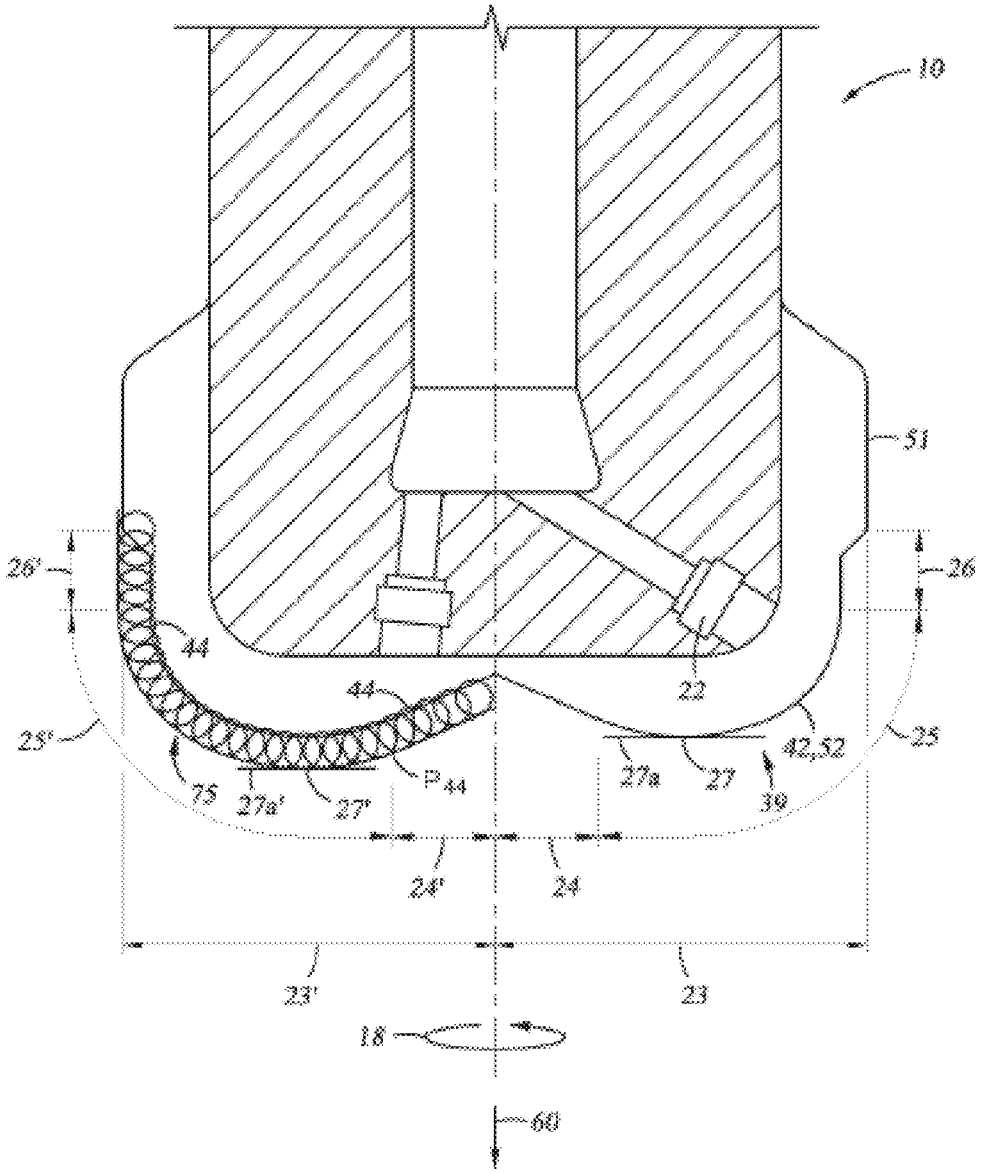
Fig. 3 (PRIOR ART)
FIG. 3 shows a cross-sectional view of drill bit.
Figure 5:
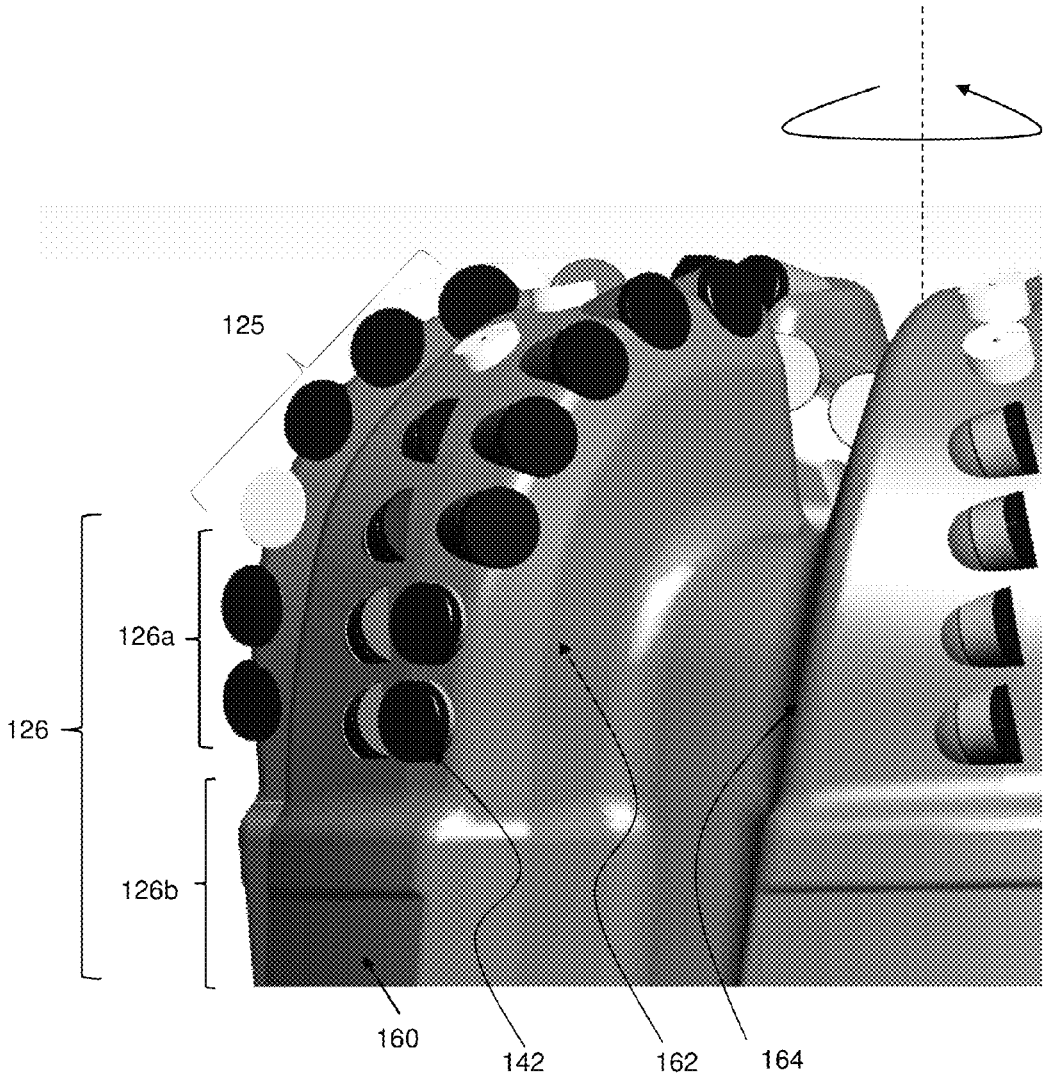
FIG. 5 shows a partial view of a drill bit according to one embodiment of the present disclosure.

The cutting elements 140 stand in contrast to the gage cutting element 142. For ease in distinguishing between the two types of cutting elements, the term "cutting elements" will refer those cutting elements in either the cone, nose, and/or shoulder region of the bit (i.e., radially inward of the gage), as described above in reference to FIGS. 1-3, and "gage cutting element" will refer to those cutting elements being located in the gage region, i.e., a portion of the blade extending substantially parallel to a bit axis. In accordance with the present disclosure, the gage cutting elements may have a substantially different backrake angle as those cutters radially inward of the gage region. The embodiment shown in FIG. 4 includes cutting elements 140 and gage cutting elements 142 on a single blade. The gage cutting element 142 may be placed proximate to the leading face of the blades 131, 132, 133, 134, 135 and 136. In some embodiments, illustrated in FIG. 5, there may be two or more "rows" 160 of gage cutting elements 142 in a gage region of a given blade, a first row proximate the leading face 162 of the blades 131-135, i.e., the face of the blade that faces in the direction of rotation of the bit, as compared to the trailing face 164, and a second row, rearwardly spaced from the first row, as shown in FIG. 5. As discussed herein, either row or both rows 160 of the gage cutting elements 142 may have greater backrake angles as compared to the radially inward cutting elements 140, as shown in FIG. 5.

Figure 6:
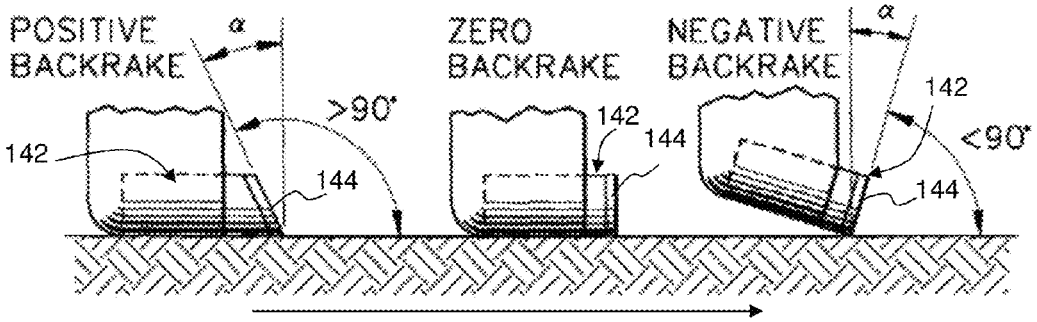
FIG. 6 shows backrake angles for according to embodiments of the present disclosure.

Generally, when positioning gage cutting elements (specifically cutters) on a blade of a bit or reamer, the cutters may be inserted into cutter pockets to change the angle at which the cutter strikes the formation. Specifically, the backrake (i.e., a vertical orientation) and the side rake (i.e., a lateral orientation) of a cutter may be adjusted. Generally, backrake is defined as the angle $\alpha$ formed between the cutting face of a cutting element, including the gage cutting element 142 and a line that is normal to the formation material being cut. As shown in FIG. 6, with a gage cutting element 142 having zero backrake, the cutting face 144 is substantially perpendicular or normal to the formation material. A gage cutting element 142 having negative backrake angle $\alpha$ has a cutting face 144 that engages the formation material at an angle that is less than 90° as measured from the formation material. Similarly, a gage cutting element 142 having a positive backrake angle $\alpha$ has a cutting face 144 that engages the formation material at an angle that is greater than about 90° when measured from the formation material.

According to various embodiments of the present disclosure, the backrake of the gage cutting element 142 may be negative, and ranging from about 20 to about 85 degrees. In other embodiments, the lower limit of the backrake angle range may be any of 20, 25, 30, 35, 40, 45, 50, 55, 60, 65, 70, 75 or 80 degrees, and the upper limit may be any of 35, 40, 45, 50, 55, 60, 65, 70, 75, 80, 85 or 90 degrees. In one or more embodiments, the backrake angle of the gage cutting element 142 may range from about 70 to 85 degree, from about 75 to 85 degrees in another particular embodiment, and from 78 to 82 degrees in yet another particular embodiment. In yet other particular embodiments, the backrake angle of the gage cutting element 142 may range from about 45 to 55 degrees and from 48 to 52 degrees in yet another particular embodiment. Thus, in some embodiments, at least one of blades 131-136 includes a gage cutting element 142 having the above described backrake angles, while in other embodiments, each of the blades 131-136 may include a gage cutting element 142 having the above described backrake angles.

Additionally, in one or more embodiments, at least one gage cutting element may be configured such that, during operation of a downhole tool, a trailing edge of the gage cutting element contacts a downhole formation prior to a leading edge of the gage cutting element, where leading and trailing are determined based on the direction of rotation of the bit. Advantageously, this arrangement may have particular advantages, in that, the force loading of the gage cutting elements may put the diamond table in compression as opposed configurations where the forces are predominantly shear forces that can lead to delamination of the gage cutting elements.

It is also within the scope of the present disclosure that one or more gage cutting elements 142 on a given blade 131-136 may have the above described backrake angle. For example, in the embodiment illustrated in FIG. 4, there are two gage cutting elements 142 on each blade 131-136, and both of the gage cutting elements 142 on each blade 131-136 are illustrated as having the above-described backrake angle. However, in other embodiments, less than all of the gage cutting elements 142 may have the above described backrake angles. Further, it is also within the scope of the present disclosure that a gage cutting element 142 proximate a shoulder region 125 of the blade may have a lower backrake angle than a gage cutting element 142 proximate a gage pad 170 and gage pad region **126*b*. In other embodiments, the gage cutting element 142 proximate a shoulder region 125 of the blade may have a greater backrake angle than a gage cutting element 142 proximate a gage pad 170 and gage pad region 126*b*. In accordance with one or more embodiments, the gage cutting elements 142 may provide protection to the structure from lateral vibration, by placing the gage cutting elements 142** at a higher backrake angle, at which orientation, the loading condition on the elements may change to a compressive load.

In one or more embodiments, active cutting gage cutting elements 142 may be disposed in the gage pad region **126*b* and extend above a gage pad 170**, increasing the effective surface area of the leading face of the downhole and increasing the contact between the gage cutting elements and the surrounding foundation. In one or more embodiments, gage cutting elements may extend above the gage pad at distances that may range from a lower limit of 0.005 inches, 0.010 inches, or 0.025 inches to any upper limit selected from the group of 0.100 inches, 0.125 inches or 0.150 inches.

Referring back to FIG. 5, gage cutting elements 142 proximate the leading face 162 are illustrated as having the above described backrake angles, while the second row of gage cutting elements 142 rearward of the gage cutting elements 142 proximate the leading face may have a lesser backrake angle, which may still fall within the above-described ranges, or may also be less than the above-described ranges. In other embodiments, the reverse may also be true. That is, the second row of gage cutting elements 142 rearward of the gage cutting elements 142 proximate the leading face 162 may have the above described backrake angles, while gage cutting elements 142 proximate the leading face 162 may have a lesser backrake angle, which may still fall within the above-described ranges, or may also be less than the above-described ranges. Additionally, it is also envisioned that the gage cutting elements proximate the shoulder region 125 may have a different backrake angle that those gage cutting elements proximate the gage pad region 126*b*, similar to as described with respect to FIG. 4.

Figure 7:
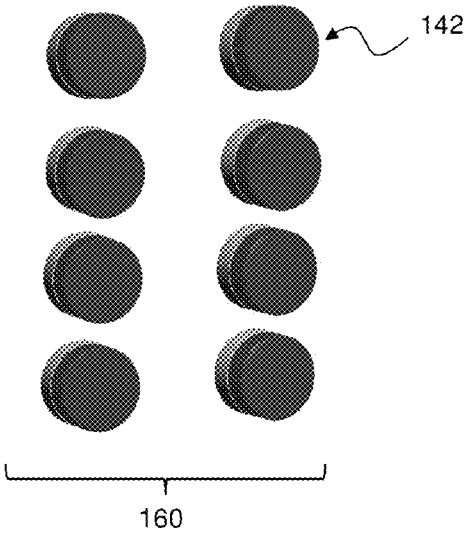
FIGS. 7 and 8 show gage cutting element arrangements according to embodiments of the present disclosure.
Figure 8:
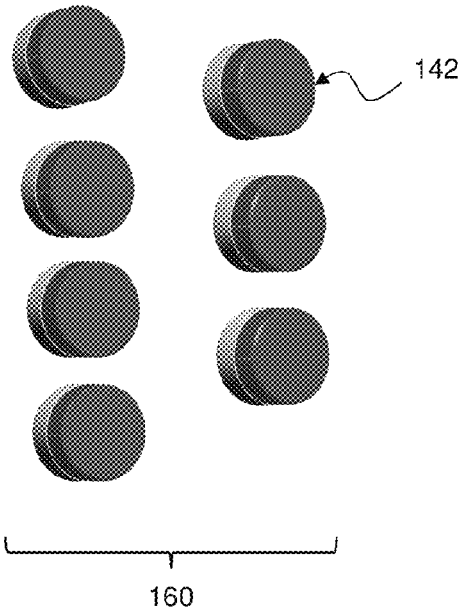
Figure 11:
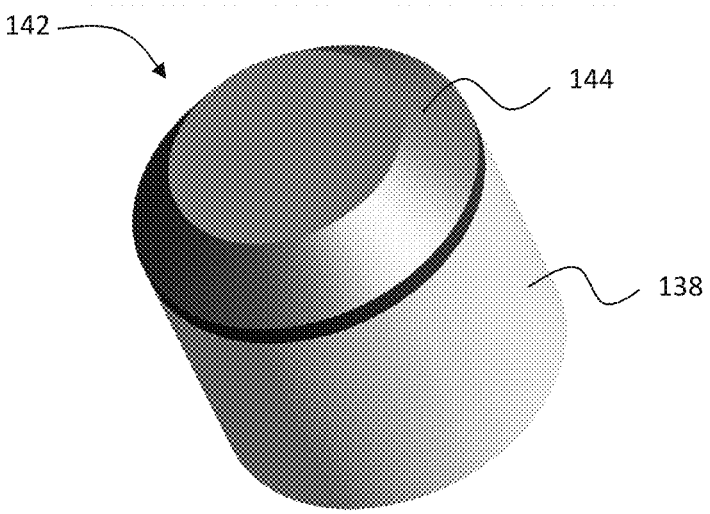
Figure 12:
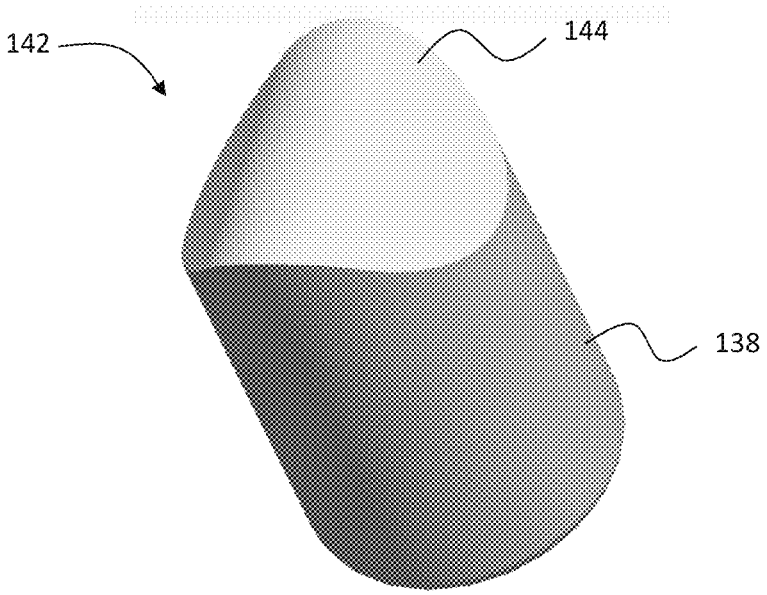

Further, as shown in FIGS. 5 and 11, the multiple rows 160 of gage cutting elements 142 are aligned with one another, i.e., a "trailing" or rearward gage cutting element 142 is at substantially the same radial position as the "leading" gage cutting element 142. However, the present disclosure is not so limited. Rather, as shown in FIG. 12, the rows 160 of gage cutting elements 142 may be offset from one another such that the a "trailing" or rearward gage cutting element(s) 142 are at different radial position(s) as the "leading" gage cutting element(s) 142. Further, it is also within the scope of the present disclosure that the rows of cutting elements may have different exposures. For example, the trailing row may have a greater or less exposure than the leading row, where the gage cutting elements having the above described backrake angles may be on the row having the greater or lesser exposure, or may be on both rows. In one or more embodiments, on a downhole tool having leading and trailing rows of gage cutting elements, the leading gage elements may have a backrake angle that ranges from any lower to any upper value discussed above (about 20 to about 85, and from 70 to 85 degrees in particular embodiments, for example) and the trailing row or second row of gage cutting elements may have a backrake angle that range from any lower limit selected from 40 degrees, 45 degrees, and 50 degrees to any upper limit selected from 80 degrees, 85 degrees, and 90 degrees. It is also within the scope of this disclosure that, for a downhole tool having at least two rows of gage cutting elements in a leading and trailing configuration, the leading and trailing gage cutting elements may be "in-line," as illustrated by FIG. 7, or staggered, as illustrated by FIG. 8, or any geometric variation encompassed by the two.

Figure 9:
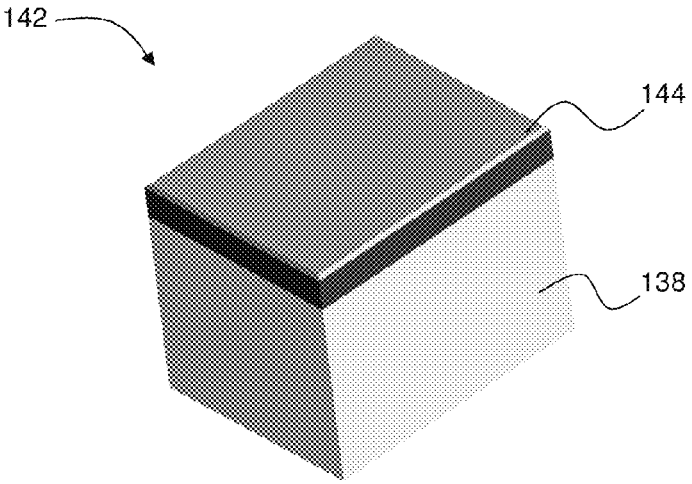
FIGS. 9 through 13 show shapes of gage cutting elements according to embodiments of the present disclosure.
Figure 10:
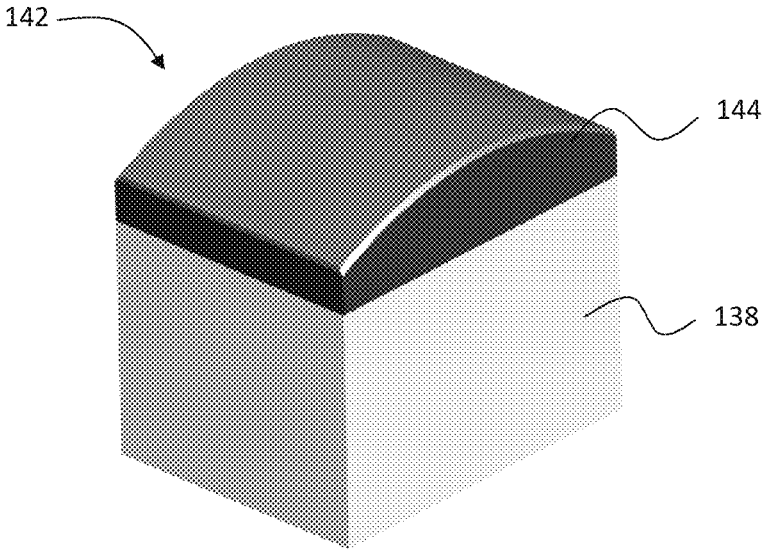
Figure 13:
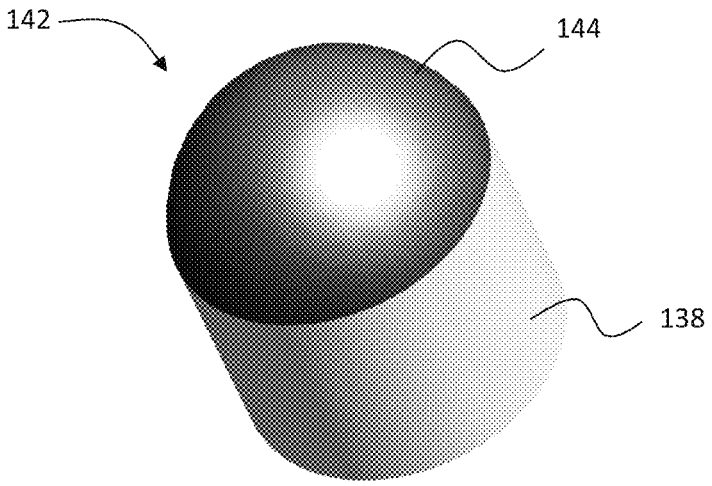

Furthermore, while FIGS. 1-8 shown above illustrate the gage cutting elements 142 as being cylindrical bodies, similar to conventional shearing cutters, the present disclosure is not so limited. Rather, the gage cutting element 142 may be of various shapes such as, but not limited to, those shown in FIGS. 9 through 13. FIG. 9 shows a gage cutting element 142 having a block shape. That is, the gage cutting element has a cuboidal body 138, with a planar, rectangular cutting face 144. FIG. 10 shows a gage cutting element 142 having a cuboidal body 138 with an arcuate, non-planar cutting face 144 that is formed by a parabola that extends along a plane of symmetry. FIG. 11 a gage cutting element 142 having a cylindrical body 138 and a truncated conical cutting face 144. FIG. 12 shows a gage cutting element 142 having a cylindrical body 138 with an arcuate, non-planar cutting face 144 that is, similar to the embodiment illustrated in FIG. 10, formed by a parabola that extends along a plane of symmetry. FIG. 13 shows a gage cutting element having a cylindrical body 138 and a domed cutting face 144. In one or more embodiments, the gage cutting element is cylindrical bodied with a pointed cutting end that terminates in a rounded apex with a conical, concave, or convex side surface, as described, for example in U.S. Patent Publication No. 2008/0035380

In other embodiments the gage cutting elements may be independently selected from cutting elements having shapes selected cuboidal with a planar rectangular cutting face, cuboidal with an arcuate non-planar cutting face, cylindrical bodied with a truncated conical cutting face, cylindrical with a conical cutting face, cylindrical bodied with an arcuate non-planar cutting face, cylindrical bodied with a planar rectangular cutting face, or cylindrical bodied with a domed cutting face.

Any shape gage cutting element may be used as known and designed by one skilled in the art. Further, any of the above types of gage cutting elements may be formed from a carbide substrate and a diamond or other ultra-hard upper layer, but may also be comprised of diamond alone (i.e., a thermally stable polycrystalline diamond material, such as a polycrystalline diamond material no Group VIII metal therein or a diamond-silicon carbide composite material), cemented carbide alone or a carbide matrix having diamond particles impregnated therein, as discussed below.

Specifically, in a particular embodiment, any of the above described gage cutting elements may be diamond impregnated inserts, such as those described in U.S. Pat. No. 6,394,202 and U.S. Patent Publication No. 2006/0081402, frequently referred to in the art as grit hot pressed inserts (GHIs), which are mounted in sockets formed in a blade to the surface of the blade and affixed by brazing, adhesive, mechanical means such as interference fit, or the like, similar to use of GHIs in diamond impregnated bits, as discussed in U.S. Pat. No. 6,394,202, or inserts may be laid side by side within the blade. Further, one of ordinary skill in the art would appreciate that any combination of the above discussed gage cutting elements may be affixed to any of the blades of the present disclosure.

In such embodiments containing diamond impregnated inserts, such impregnated materials may include super abrasive particles dispersed within a continuous matrix material, such as the materials described below in detail. Further, such preformed inserts may be formed from encapsulated particles, as described in U.S. Patent Publication No. 2006/0081402 and U.S. application Ser. Nos. 11/779,083, 11/779,104, and 11/937,969. The super abrasive particles may be selected from synthetic diamond, natural diamond, reclaimed natural or synthetic diamond grit, cubic boron nitride (CBN), thermally stable polycrystalline diamond (TSP), silicon carbide, aluminum oxide, tool steel, boron carbide, or combinations thereof. In various embodiments, certain portions of the blade may be impregnated with particles selected to result in a more abrasive leading portion as compared to trailing portion (or vice versa).

The impregnated particles may be dispersed in a continuous matrix material formed from a matrix powder and binder material (binder powder and/or infiltrating binder alloy). The matrix powder material may include a mixture of a carbide compounds and/or a metal alloy using any technique known to those skilled in the art. For example, matrix powder material may include at least one of macrocrystalline tungsten carbide particles, carburized tungsten carbide particles, cast tungsten carbide particles and sintered tungsten carbide particles. In other embodiments non-tungsten carbides of vanadium, chromium, titanium, tantalum, niobium, and other carbides of the transition metal group may be used. In yet other embodiments, carbides, oxides and nitrides of Group IVA, VA, or VIA metals may be used. A binder phase may be formed from a powder component and/or an infiltrating component. In some embodiments of the present invention, hard particles may be used in combination with a powder binder such as cobalt, nickel, iron, chromium, copper, molybdenum and their alloys, and combinations thereof. In various other embodiments, an infiltrating binder may include a Cu—Mn—Ni alloy, Ni—Cr—Si—B—Al—C alloy, Ni—Al alloy, and/or Cu—P alloy. In other embodiments, the infiltrating matrix material may include carbides in amounts ranging from 0 to 70% by weight in addition to at least one binder in amount ranging from 30 to 100% by weight thereof to facilitate bonding of matrix material and impregnated materials. Further, even in embodiments in which diamond impregnation is not provided (or is provided in the form of a preformed insert), these matrix materials may also be used to form the blade structures into which or on which the cutting elements of the present disclosure are used.

Further, it is also within the scope of the present disclosure that the cutting elements 140 used radially inward from the gage region 126 may be of any type of cutting element known in the art, including conventional PDC cutters, rotatable cutting elements, conical cutting elements, and may also include one or more rows of cutting elements. Further, there is also no limitation on the orientation or placement of the radially inward cutting elements 140.

Figure 14:
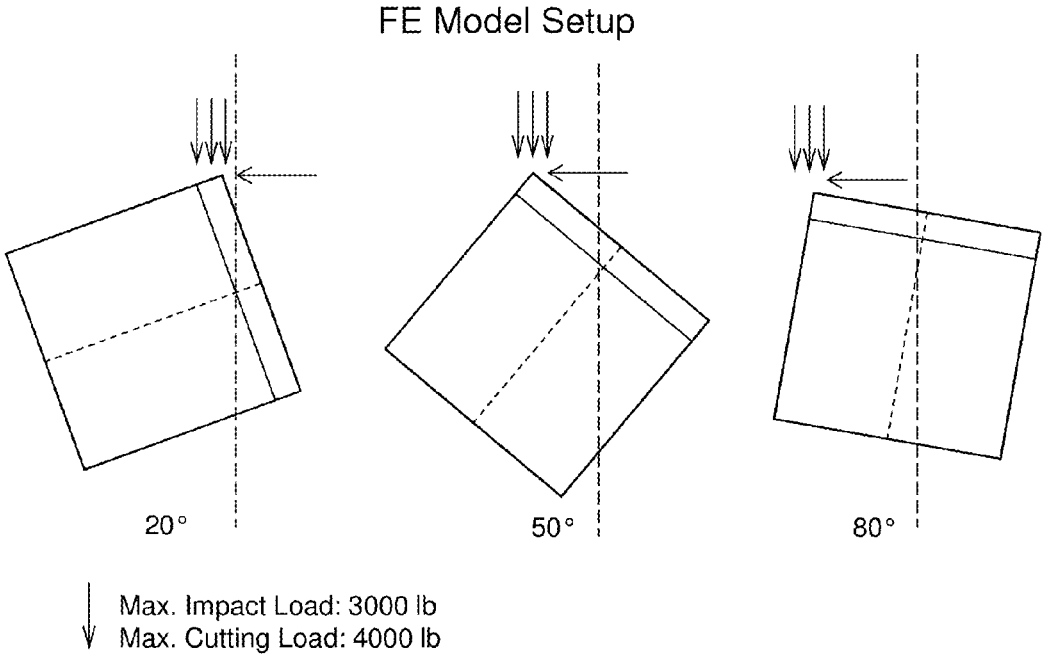
FIG. 14 shows backrake angle setups according to embodiments of the present disclosure.

To estimate the effect of backrake angle for reducing damage during drilling, a finite element analysis was performed. A pre-stressed finite element model using sintering simulation was done to reflect the thermal residual stress. Three backrake angles were compared, about 20 degrees, about 50 degrees and about 80 degrees for two different loading conditions, lateral impact and cutting load, as shown in FIG. 14. The results are summarized in Table 1 below.

TABLE 1

Backrake Angle vs Loading Conditions

| Loading | Stress | 20 degrees | 50 degrees | 80 Degrees | Change (%, 80° v 20°) |
|---|---|---|---|---|---|
| Impact | Shear (ksi) | 139 | 90 | 35 | −71.9% |
| | Tensile (ksi) | 60 | 12 | 13 | −78.3% |
| | Max. Principle (ksi) | 78 | 45 | 40 | −48.7% |
| Cutting | Shear (ksi) | 28 | 28 | 28 | 0.0% |
| | Tensile (ksi) | 15 | 14 | 12 | −20.0% |
| | Max. Principle (ksi) | 98 | 107 | 46 | −53.1% |
| Contact Area ($10^{-3}$ in$^2$) | | 16.61 | 15.79 | 72.21 | +334.7% |

The shear and tensile stress under lateral impact decreases with higher backrake angles, providing a reduction in impact damages on the gage cutters. The maximum principle stress on the diamond tip under both lateral impact and cutting load decreases with higher backrake angle, which may result in less chipping. Further, the contact area is much larger for the 80 degree backrake angle having the same depth of cut, as compared to a 20 degree backrake angle, to accommodate applied loads; however, by design, if the bit is running stable, the gage cutter should very minimal depth of cut and should not take much of the cutting load.

As described throughout the present disclosure, the gage cutting elements may be used on either a fixed cutter drill bit or hole opener. Moreover, in addition to downhole tool applications such as a hole opener, reamer, stabilizer, etc., a drill bit using gage cutting elements according to various embodiments of the invention such as disclosed herein may have improved drilling performance at high rotational speeds as compared with prior art drill bits. Such high rotational speeds are typical when a drill bit is turned by a turbine, hydraulic motor, or used in high rotary speed applications.

Additionally, one of ordinary skill in the art would recognize that there exists no limitation on the sizes of the cutting elements of the present disclosure. For example, in various embodiments, the gage cutting elements may be formed in sizes including, but not limited to, 9 mm, 13 mm, 16 mm and 19 mm. Selection of gage cutting element sizes may be based, for example, on the type of formation to be drilled. For example, in softer formations, it may be desirable to use a larger gage cutting element, whereas in a harder formation, it may be desirable to use a smaller gage cutting element.

Further, it is also within the scope of the present disclosure that the gage cutters 142 in any of the above described embodiments may be rotatable cutting elements, such as those disclosed in U.S. Pat. No. 7,703,559, U.S. Patent Publication No. 2010/0219001, and U.S. Patent Application No. 61/351,035, all of which are assigned to the present assignee and herein incorporated by reference in their entirety.

Further, while many of the above described embodiments described cutters and gage cutting elements being located at different radial positions from one another, it is intended that a gage cutting element may be spaced equidistant between the radially adjacent cutters (or vice versa with respect to a cutter spacing between gage cutting elements), but it is also envisioned that non-equidistant spacing may also be used.

Embodiments of the present disclosure may include one or more of the following advantages. Embodiments of the present disclosure may provide for fixed cutter drill bits or other fixed cutter cutting tools capable of drilling effectively at economical ROPs and in formations having a hardness greater than in which conventional PDC bits can be employed. More specifically, the present embodiments may drill in soft, medium, medium hard, and even in some hard formations while maintaining an aggressive cutting element profile so as to maintain acceptable ROPs for acceptable lengths of time and thereby lower the drilling costs presently experienced in the industry. Additionally, other embodiments may also provide for enhanced durability by transition of the cutting mechanism to abrading (by inclusion of diamond impregnation).

While the disclosure has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A downhole cutting tool, comprising:

a tool body comprising a pin end;

a plurality of blades extending azimuthally from the tool body comprising a cone region, a shoulder region, and a gage region at an outer diameter of the tool body;

at least one cutting element disposed along the cone region and the shoulder region of a first blade of the plurality of blades;

a first gage cutting element proximate to a leading face of the first blade and disposed along the gage region of the first blade wherein the first gage cutting element has a negative backrake angle ranging from greater than 70 degrees to 85 degrees;

a second gage cutting element disposed along the gage region of a second blade of the plurality of blades, wherein the second gage cutting element has a negative backrake angle ranging from greater than 70 degrees to 85 degrees; and a trailing gage cutting element disposed on the first blade, the trailing gage cutting element having a lesser backrake angle than the first gage cutting element.

2. The downhole cutting tool of claim 1, wherein the trailing gage cutting element has a negative backrake angle of at least 20 degrees.

3. The downhole cutting tool of claim 1, further comprising:

at least one gage pad disposed along a side of the tool body.

4. The downhole tool of claim 3, further comprising at least one gage cutting element disposed in the gage region between the gage pad and the shoulder region and separated from the gage pad at a distance that ranges from 0.005 inches to 0.125 inches.

5. The downhole cutting tool of claim 1, wherein the first gage cutting element has a non-planar cutting face.

6. The downhole cutting tool of claim 1, wherein the first gage cutting element has a negative backrake angle ranging from 75 to 85 degrees.

7. The downhole cutting tool of claim 1, wherein the first gage cutting element has a negative backrake angle ranging from 78 to 82 degrees.

8. The downhole cutting tool of claim 1, wherein the second gage cutting element trails the first gage cutting element.

9. The downhole tool of claim 8, wherein the second gage cutting element has a backrake angle greater than the first gage cutting element.

10. A downhole cutting tool, comprising:

a tool body;

a plurality of blades extending azimuthally from the tool body comprising a cone region, a shoulder region, and a gage region;

at least one cutting element disposed along the cone region and the shoulder region of a first blade;

a first gage element and a second gage element disposed in a first row along a leading face of the gage region of the first blade, the first and second gage elements each having a negative backrake angle ranging from greater than 35 to less than 90 degrees, a third gage cutting element disposed along the gage region of a second blade of the plurality of blades, the second gage cutting element having a negative backrake angle ranging from greater than 35 to less than 90 degrees;

a second row of gage cutting elements on the first blade, the gage cutting elements of the second row having a lesser backrake angle than the first and second gage cutting elements of the first row; and a gage pad, wherein the first gage cutting element is proximate the shoulder region and the second gage cutting element is proximate the gage pad; and wherein the first gage cutting element and the second gage cutting element have differing backrake angles.

11. The downhole cutting tool of claim 10, wherein the first gage cutting element has a lesser backrake angle than the second gage cutting element.

12. The downhole cutting tool of claim 11, wherein the second gage cutting element has a negative backrake angle of at least 70 degrees.

13. The downhole cutting tool of claim 10, wherein the backrake angle of the second row of gage cutting elements ranges from 40 degrees to 90 degrees.

14. A downhole cutting tool, comprising:

a tool body;

a plurality of blades extending azimuthally from the tool body comprising a cone region, a shoulder region, and a gage region;

at least one cutting element disposed along the cone region and the shoulder region of a first blade; and at least two gage cutting elements disposed along the gage region of the first blade, wherein one of the at least two gage cutting elements trails the other at the same radial position, wherein the one of the at least two gage cutting elements having a lesser backrake angle than the other gage cutting element, wherein the other gage cutting element has a negative backrake angle greater than 35 degrees and less than 90 degrees.

* * * * *